United States Patent [19]

Sutton

[11] 4,311,278

[45] Jan. 19, 1982

[54] NOZZLE INJECTION UNIT

[75] Inventor: Gordon W. Sutton, Bisley, England

[73] Assignee: The British Petroleum Company Limited, London, England

[21] Appl. No.: 62,629

[22] Filed: Aug. 1, 1979

[30] Foreign Application Priority Data

Aug. 4, 1978 [GB] United Kingdom ..... 32349/78

[51] Int. Cl.[3] ..... F23D 19/00

[52] U.S. Cl. ..... 239/419.3; 118/DIG. 5; 239/423; 239/426; 239/431; 432/58

[58] Field of Search ..... 239/419.3, 423, 426, 239/428, 429, 431; 118/DIG. 5; 431/7, 170; 122/4 D; 432/58; 110/182.5, 245

[56] References Cited

U.S. PATENT DOCUMENTS

| | | | |
|---|---|---|---|
| 3,493,181 | 2/1970 | Goodnight et al. | 239/419.3 |
| 3,610,536 | 10/1971 | Pease et al. | 239/419.3 |
| 3,958,916 | 5/1976 | Barker et al. | 431/170 |
| 4,148,437 | 4/1979 | Barker et al. | 239/419.3 |

*Primary Examiner*—Andres Kashnikow

*Attorney, Agent, or Firm*—Morgan, Finnegan, Pine, Foley & Lee

[57] ABSTRACT

A nozzle injection unit for an oil fired fluid combustor has a pair of co-axial tubes sealed together at one end. The outer tube has an inlet and lateral outlets near the sealed end and is connected to an air supply. The inner tube is connected to a fuel oil supply and has a number of circumferential lateral outlets communicating with the outer tube. The oil emerging from the inner tube is carried by the air flow in the outer tube into the fluidized bed where it is ignited and consumed.

18 Claims, 1 Drawing Figure

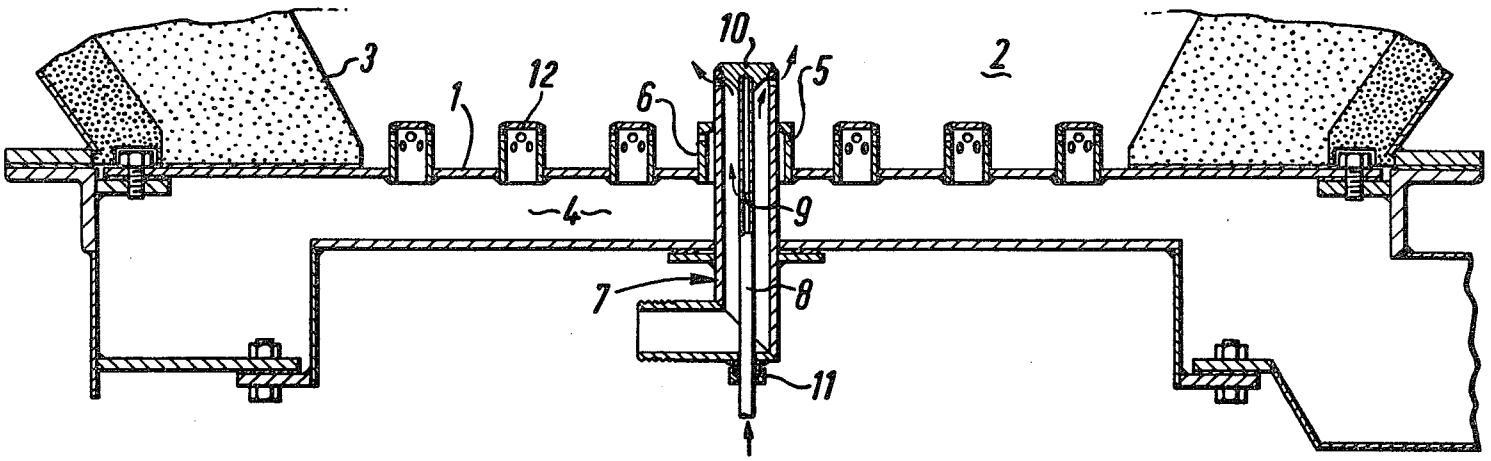
2
5
10
6
12
1
3
9
8
11
7
4

Preferably start up of the bed may be achieved as described in U.K. Pat. No. 1,159,310 or by an overhead burner.

Preferably prior to the fluidised bed combustor being used for liquid fuel burning, the bed is pre-heated by burning a fuel gas, e.g. propane in the bed, through an inlet in the outer tube, as, for example, disclosed in the aforesaid U.S. Pat. Nos. 4,165,040 (Column 2, lines 48–52) and 3,958,916 (Column 2, lines 48–52).

The invention will now be described by way of example only with reference to the accompanying drawing which shows a vertical section through a distributor plate having a single nozzle injection unit.

A fluidised combustor comprises a distributor plate 1 above which is located a fluidised bed 2 of sand. The bed 2 is contained by a refractory lined or water cooled vessel 3.

An air plenum chamber 4 is connected to a source of pressurized air (not shown) and communicates with the fluidised bed 2 by means of outlets 5 in tube 6, projecting upwards into the bed 2 from the air plenum chamber 4. A further tube 7, which is co-axial with tube 6 passes through and above tube 6 and also extends downwards through the air plenum chamber 4 to a point below the distributor plate where it is connected to a pressurised air supply (which may be the same as for the air plenum chamber 4 or be a separate supply).

An inner central tube 8, co-axial with tubes 6,7 is connected to tube 7 at a point above its outlets 9 by means of the connecting member 10 and passes down to a fuel oil supply (not shown) beneath the distributor plate. The tube 8 is separable from the connecting member 10 and may be withdrawn if desired from the distributor plate through a sealed fitting 11. The use of a connecting member 10 enables the oil feed pipe 8 to be accurately located with respect to the surrounding tube 7. A number of air only nozzles 12 surround the nozzle injection unit to provide fluidising and oxidising air.

A combustor was operated with a single oil nozzle with gas oil, residual fuel oil and vacuum residue for periods up to 100 hours duration respectively. Results are shown in the table 1. The bed was not operated at temperatures greater than about 700° C. with gas oil and 780° C. with residual fuel oil in the 3 to 5 hour tests. At these conditions the $O_2$ concentration in the exhaust gas was 0.5%. Some CO was produced, but the amount of smoke from the stack was negligible. Tests with residual fuel oil and vacuum residue at higher oxygen content and with reduced in-bed heat transfer surface are shown in Examples 3 and 4.

TABLE 1

| Test Duration (hours) | Configuration | Bed Temp. °C. | F/board temp. °C. | Gas composition % °Z | Gas composition % CO | Fluidising velocity ft/s | % of air to oil nozzle |
|---|---|---|---|---|---|---|---|
| 5 | 1 oil nozzle | 780 | 800 | 0.5 | 2.0 | 7.7 | 16 |
| | | 3. Fuel:- Residual Fuel Oil | | | | | |
| 100 | 1 oil nozzle | 835 | 765 | 3.0 | 0.05 | 7.5 | 20 |
| | | 4. Fuel:- Vacuum Residue | | | | | |
| 65 | 1 oil nozzle | 835 | 730 | 3.0 | 0.05 | 6.4 | 23 |

The internal diameters of tubes 6,7 and 8 were 67 mm, 38 mm, and 6 mms. respectively. The density of nozzle injection units was 0.1 per square foot.

In addition to the above combustion experiments, further cold modelling experiments have given the results indicated in Tables 2 and 3. Table 2 give details of the nozzle injection units for various tests and Table 3 shows nozzle injection unit operating conditions. The tests were made to compare the effect of oil feed to the bed by the axial oil feed of the present invention with the side oil feed of the climbing film oil injection technique of G.B. Pat. No. 1,487,391.

The results illustrate that a significantly lower pressure drop down the nozzle injection unit is required for the same oil feed rate to the bed for the axial as opposed to the side oil injection technique.

TABLE 2

| Test No. | Tube Length mms | Tube Internal Diameter ms | Tube Wall Thickness mms | Nozzle Cap Shape | EXIT HOLES Diameter mms | EXIT HOLES Number | EXIT HOLES Rows |
|---|---|---|---|---|---|---|---|
| 1 | 1485 | 26 | 2 | flat | 5.5 | 12 | 2 |
| 2 | 650 | 38 | 3 | conical | 4.0 | 24 | 1 |
| 3 | 650 | 38 | 3 | conical | 4.0 | 24 | 1 |
| 4 | 355 | 38 | 3 | conical | 4.8 | 30 | 2 |
| 5 | 355 | 38 | 3 | flat | 4.8 | 30 | 2 |
| 6 | 420 | 26 | 3 | flat | 4.8 | 16 | 2 |
| 7 | 420 | 26 | 3 | conical | 4.8 | 16 | 2 |

TABLE 3

| Test No. | Method of oil feed to tube | Oil feed aperture diameter mms | Height of climbing oil film mms | Nozzle pressure drop at oil flow: inches water gauge | Nozzle pressure drop at oil flow: gallons of oil/nozzle/hour gph | Oil flow per orifice at outlet of nozzle gph | Air velocity at nozzle exit ft/sec | Oil Viscosity centi-strokes |
|---|---|---|---|---|---|---|---|---|
| 1 | side | 9.5 | 1420 | 42.8 | 10.0 | 0.833 | 246.4 | 290 |
| | | | | 45.0 | 20.0 | 1.667 | 251.9 | 280 |
| | | | | 53.0 | 30.0 | 2.500 | 269.7 | 270 |
| | | | | 48.2 | 40.0 | 3.333 | 259.9 | 260 |
| 2 | axial | 4 × 3.2 | 0 | 26.8 | 5.0 | 0.808 | 188.5 | 300 |
| | | | | 24.1 | 10.0 | 0.417 | 178.6 | 310 |
| | | | | 21.4 | 20.0 | 0.833 | 168.1 | 509 |
| 3 | axial | 4 × 3.2 | 0 | 16.1 | 5.0 | 0.208 | 137.4 | 390 |
| | | | | 18.7 | 10.0 | 0.417 | 148.7 | 450 |
| 4 | axial | 4 × 3.0 | 150 | 11.8 | 10.0 | 0.333 | 136.2 | 293 |
| | | | | 13.4 | 20.0 | 0.667 | 145.2 | 304 |
| | | | | 13.9 | 30.0 | 1.000 | 147.5 | 312 |
| | | | | 15.5 | 40.0 | 1.333 | 155.8 | 334 |
| 5 | side | 8.0 | 305 | 19.8 | 20.0 | 0.667 | 200.0 | 464 |
| | | | | 20.8 | 30.0 | 1.000 | 204.2 | 460 |

NOZZLE INJECTION UNIT

The present invention relates to fluidised bed combustors and more particularly relates to nozzles for supply of fuel to a fluidised bed combustor.

A fluidised bed combustor is operated by blowing air through a bed of inert particulate material to maintain the bed in a fluidised state and injecting fuel into the bed so that combustion occurs. The fuel, which may be solid, liquid or gaseous, or a mixture, burns within the bed which is maintained at a temperature which may typically be in the range 700°–1000° C. by controlled extraction of heat.

Fluidised bed combustors are capable of very high heat outputs per unit volume capacity and high rates of heat transfer can be transmitted to cooling surfaces immersed in the bed. The use of the term "fluidised bed combustor or furnace" is intended to cover the use of a fluidised bed as both a combustor and as a gasifier whereby partial reaction of a fuel and an oxygen containing gas produces a combustible gas which may be stored or burned at a point remote from the fluidised bed.

Difficulties, however, have sometimes been encountered in supplying liquid fuels, such as fuel oil to fluidised bed furnaces, since there is a tendency for supply nozzles to become blocked, and the combustion characteristics can be very sensitive to fuel distribution.

British Pat. No. 1,502,764 describes a distributor plate suitable for use in a fluidised bed furnace, the plate comprising first and second co-axial tubes, the second tube surrounding part of the first tube, each of the first and second co-axial tubes having an inlet for an air supply and an outlet, which outlet comprises a lateral passageway through the tube wall, the first co-axial tube projecting beyond and having its outlet above the outlet of the second co-axial tube, there also being a further tube having an inlet for a fuel oil supply and having its outlet within the first co-axial tube.

British Pat. No. 1,487,391 describes a distributor plate suitable for use in a fluidised bed furnace comprising a chamber having a fuel inlet and an air tube passing through the chamber, the interior of the air tube being in communication with the chamber, one end of the air tube terminating in a head having outlets adapted to supply a combustible mixture including fuel and air to a fluidised bed there being a surrounding tube around the air tube, which surrounding tube has an air inlet and air outlet, the air outlet being adapted to supply air to a region of the fluidised bed beneath the head supplying the combustible mixture to the fluidised bed.

However, when using these distributor plates, conditions of oil flow within the tube can occur which lead to an uneven supply of fuel from the nozzle head to the fluidised bed. The present invention is intended to give an improved means for introducing liquid fuel more uniformly to the fluidised bed and enabling lower air pressures to be used.

Thus, according to the present invention there is provided a nozzle injection unit suitable for use in a fluidised bed combustor, the nozzle injection unit comprising first and second co-axial tubes, the second co-axial tube having an inlet at one end for a liquid fuel supply and being sealed at the other end and having one or more lateral outlets within the first co-axial tube, the first co-axial tube having lateral outlets at one end, the space between the first and second co-axial tubes being connectable to a supply of oxygen containing gas and the lateral outlets of the second co-axial tube being at a distance of not more than eight and not less than two first co-axial tube internal diameters upstream of the lateral outlets of the first co-axial tube.

Preferably the first co-axial tube is sealed to the second co-axial tube at the top of the second co-axial tube. This allows a more even oil feed into the bed to be achieved as the oil can leave the outlets of the second co-axial tube by both the upper and lower edges of the outlets as well as by direct air entrainment in comparison to the case where the tubes are separate in which oil enters the bed mainly by the lower edge of the outlet and by direct entrainment only. Thus, in this preferred embodiment, three modes of liquid fuel transport can occur into the fluid bed (a) by direct air entrainment (b) by formation of a climbing film of liquid fuel on the inner wall of the first co-axial tube and (c) by formation of a climbing film of liquid fuel on the outer wall of the second co-axial tube thereby achieving the aforementioned more uniform oil feed to the bed.

The use of the term co-axial in this context is also intended to include tubes lying one within the other, which are not co-axial in the strict sense.

The specific restriction of the position of the fuel outlet of the second tube and the lateral outlet of the first tube is necessary as there is a tendency for fuel supply to enter the bed unevenly if the fuel emerges too near the outlet of the first tube whereas on the other hand an increased air pressure drop is required to entrain the fuel if the outlet of the first tube is too distant from the lateral outlet of the first tube into the fluidised bed.

The oxygen containing gas supply is pressurized and contributes wholly or partly to fluidisation of the bed material.

The liquid fuel may be, for example, fuel oil, vauum residue, kerosene or gas oil. Typical liquid fuel pressures used are 5 to 25 psig.

The invention also comprises a distributor plate for a fluidised bed which distributor plate preferably comprises a plurality of fuel nozzle injection units.

The density of the fuel nozzle injection units may be varied to suit each particular requirement and preferably a density of nozzle injection units of 0.1 to 6 per square foot is used. (Additional air for fluidising and combustion purposes may be supplied by tubes passing through the distributor plate).

The lateral outlets of the co-axial tubes form passageways through the tube walls, the direction of the passageways being preferably substantially perpendicular to the tube wall.

The shortened fuel path relative to the nozzle of, for example, our U.K. Pat. No. 1,368,352 makes pre-heat of the fluidising air less critical when burning heavy fuels and contributes to reducing the pressure drop across the nozzle.

The air and oil tubes may be designed so that they are removable, e.g. for cleaning and inspection, while the fluidised bed combustor is in operation by a method similar to that described in our U.S. Pat. No. 4,165,040.

Preferably a conical fluidised bed of the type disclosed in our U.S. Pat. No. 4,171,945 is used.

The bed itself comprises mineral particles of a size range and bulk density appropriate to the velocity of the fluidising gas.

TABLE 3-continued

| Test No. | Method of oil feed to tube | Oil feed aperture diameter mms | Height of climbing oil film mms | Nozzle pressure drop at oil flow: inches water gauge | Nozzle pressure drop at oil flow: gallons of oil/nozzle/hour gph | Oil flow per orifice at outlet of nozzle gph | Air velocity at nozzle exit ft/sec | Oil Viscosity centi-strokes |
|---|---|---|---|---|---|---|---|---|
| | | | | 21.9 | 40.0 | 1.333 | 209.4 | 450 |
| 6 | side | 3.0 | 370 | 33.0 | 10.0 | 0.625 | 220.1 | 292 |
| 7 | axial | 4 × 3.0 | 100 | 23.0 | 10.0 | 0.625 | 166.7 | 252 |

I claim:

1. A nozzle injection unit comprising first and second generally co-axial tubes, the second co-axial tube having an inlet at one end for a liquid fuel supply and the second co-axial tube being sealed at the other end and having at least one lateral outlet within the first co-axial tube, the first co-axial tube having lateral outlets at one end, the space between the first and second co-axial tubes being connectable to a supply of oxygen containing gas and the lateral outlets of the second co-axial tube being at a distance of not more than eight times and not less than twice the internal diameter of the first co-axial tube upstream of the lateral outlets of the first co-axial tube.

2. A nozzle injection unit according to claim 1 in which the first co-axial tube is sealed to the second co-axial tube at the top of the second co-axial tube.

3. A nozzle injection unit according to claim 1 in which the lateral outlets of the first co-axial tube are at right angles to the wall of the tube.

4. A nozzle injection unit according to any of claims 1 to 3 in which the lateral outlets of the second co-axial tube are at right angles to the wall of the tube.

5. A nozzle injection unit according to claim 2 in which the lateral outlets of the first co-axial tube are at right angles to the wall of the tube.

6. A nozzle injection unit according to any of claims 1 to 3 or 5 in which a third co-axial tube partly surrounds the first co-axial tube and has an inlet for a supply of an oxygen containing gas and a lateral outlet.

7. A nozzle injection unit according to claim 5 in which the third co-axial tube also has an inlet for a fuel gas supply.

8. A distributor plate having at least one nozzle injection unit comprising first and second generally co-axial tubes, the second co-axial tube having an inlet at one end for a liquid fuel supply and the second co-axial tube being sealed at the other end and having at least one lateral outlet within the first co-axial tube, the first co-axial tube having lateral outlets at one end, the space between the first and second co-axial tubes being connectable to a supply of oxygen containing gas and the lateral outlets of the second co-axial tube being at a distance of not more than eight times and not less than twice the internal diameter of the first co-axial tube upstream of the lateral outlets of the first co-axial tube.

9. A distributor plate according to claim 8 in which the first co-axial tube is sealed to the second co-axial tube at the top of the second co-axial tube.

10. A distributor plate according to claim 8 in which the lateral outlets of the first co-axial tube are at right angles to the wall of the tube.

11. A distributor plate according to claim 9 wherein the lateral outlets of the first co-axial tube are at right angles to the walls of the tube.

12. A distributor plate according to any of claims 8–11 in which the lateral outlets of the second co-axial tube are at right angles to the wall of the tube.

13. A distributor plate according to claim 12 in which the third co-axial tube also has an inlet for a fuel gas supply.

14. A distributor plate according to claim 13, which includes a plurality of said nozzle injection units arranged in a density of from about 0.1 to about 6 units per square feet.

15. A distributor plate according to claim 12, which includes a plurality of said nozzle injection units arranged in a density of from about 0.1 to about 6 units per square feet.

16. A distributor plate according to any of claims 8–11 in which a third co-axial tube partly surrounds the first co-axial tube and has an inlet for a supply of an oxygen containing gas and a lateral outlet.

17. A distributor plate according to claim 16, which includes a plurality of said nozzle injection units arranged in a density of from about 0.1 to about 6 units per square feet.

18. A distributor plate according to any of claims 8–11, which includes a plurality of said nozzle injection units arranged in a density of from about 0.1 to about 6 units per square feet.

* * * * *